US005488808A

United States Patent [19]

Cahill et al.

[11] Patent Number: 5,488,808

[45] Date of Patent: Feb. 6, 1996

[54] INTERLOCK FOR WALL PANEL SYSTEM

[75] Inventors: James M. Cahill, Aurora; Dale E. White, Sandwich, both of Ill.

[73] Assignee: Allsteel Inc., Aurora, Ill.

[21] Appl. No.: 251,918

[22] Filed: Jun. 1, 1994

[51] Int. Cl.[6] ..... E04B 2/82

[52] U.S. Cl. ..... 52/584.1; 52/127.11; 52/127.12; 52/582.2; 292/241; 292/256.75; 292/257

[58] Field of Search ..... 52/584.1, 127.11, 52/127.12, 582.2; 411/273, 423; 292/256.73, 256.75, 257, 241; 403/343, 374, 409.1

[56] References Cited

U.S. PATENT DOCUMENTS

| | | | |
|---|---|---|---|
| 416,359 | 12/1889 | Cooley | 292/257 |
| 922,122 | 5/1909 | Frazier | 292/256.75 |
| 1,229,851 | 6/1917 | Abererombie . | |
| 1,451,768 | 4/1923 | Falls . | |
| 2,970,677 | 2/1961 | Springs, Jr. et al. | 52/127.12 X |
| 4,729,584 | 3/1988 | Beckerer, Jr. | 292/257 |
| 4,763,957 | 8/1988 | Poehlmann et al. | 411/432 X |
| 4,881,349 | 11/1989 | Brown et al. . | |

*Primary Examiner*—Carl D. Friedman
*Assistant Examiner*—Christopher Todd Kent
*Attorney, Agent, or Firm*—Lee, Mann, Smith, McWilliams, Sweeney & Ohlson

[57] ABSTRACT

An interlock system for locking wall panel frames. Vertical frame members are provided with keyhole-shaped openings for receipt therethrough of the head of a carriage bolt in one portion and having and a second elongate slotted portion capable of a non-rotationable engagement with the carriage bolt. A threaded shaft of the carriage bolt being threadably engageable by a dowel freely rotationally held by a lever bracket whereby the dowel can be threaded along the threaded shaft to bring the lever bracket against one of the vertical frame members. The latch bracket having camming edges and being pivotal around said dowel in a past-center relation whereby to cam said camming edges against the second frame member and lock the two vertical frame members together without the use of hand tools. Access from only one side of a panel frame joint is necessary to engage or disengage the interlock system. Only one interlock is required in vertical frame members having at a separate location conventional hook and slot engageable attachments, or equivalent.

21 Claims, 4 Drawing Sheets

INTERLOCK FOR WALL PANEL SYSTEM

BACKGROUND OF THE INVENTION

The invention generally relates to room divider systems and devices used for locking adjoining panels in the system together. The invention is more directly related to wall panel systems supported by vertical frame members, particularly of the type used to divide office space into individual work spaces or stations. The invention is particularly directed to wall panel systems having panels removably supported on vertical frame members wherein the wall panel arrangement may be readily re-arranged.

Typically, office wall panel divider systems are erected with tubular vertical frame members that abut one another and which are individually connected to horizontal upper and lower frame members to form a panel frame for the mountable attachment of decorative wall panels thereon. In order to fasten the system together, the vertical frame members in the prior art have been interlocked in a variety of ways. One standard method is to provide for a hook-type engagement wherein a hook, tang, prong-like projection, or the like, on one vertical frame member engages a matable slot, notch, aperture, etc., in the other. Thereafter, mechanical fasteners are typically utilized to lock the two frame members at a location elsewhere along the length of the adjacent vertical member. Both the hook and the mechanical fastener connect the vertical frame members and thereby secure the panel frames.

The typical utilization of bolts and other threaded fasteners, including lock nuts and the like, for locking panel frames together have generally required the use of hand tools. It would be desirable to eliminate the need for hand tools and yet provide a very secure interlock between the vertical frame members.

Some systems have used a past-center type of camming device that does not require the use of hand tools for interlocking panels. One type of such device is shown in U.S. Pat. No. 4,881,349, wherein vertical frame members are provided to have aligned slot-like openings. A "T" end of a two-piece hinged clamping member is passed through the slots and then rotated 90°. A second part of the clamp consists of an actuator that is pivotally connected at two points on the opposite end of the "T" end member and includes camming surfaces for camming against the exterior of the other frame member when rotated about 90° to a past-center locked position. That system however creates a need for elongate abutment strips arranged along the vertical frame members, which that are compressible upon locking to help accurately align the panels and tighten otherwise loose fits together in a snug arrangement. The system of U.S. Pat. No. 4,881,349 allows for no relative adjustment of the two-piece clamping members caused by the material irregularities, deformations, slots form outside of tight-fit, tolerances and the inherent disparity in the hinged "play" in the freely pivotal actuator member. The use of the resilient abutting strip might therefore become a necessary element to take up the slack caused by errors in machining tolerances, material and dimension errors in fabrication, and other manufacturing defects, even though slight.

This camming-type of actuator device of U.S. Pat. No. 4,881,349 also does not allow for the utilization of washers, or other forced-distributing means, that would offer a more even surface for distributing the locking force on the faces of tubular frame members. Washers, or the like, cannot be used because the actuator and "T"-shaped insert members are hingedly joined together permanently during manufacturing and allow for no introduction of a force distributing element to aid in securement or provide for a sure camming surface for the actuator member. The actuator member of this prior art patent pulls the "T"-shaped insert member directly against the face of the frame members in two point loadings made by each arm of the "T" , which can cause material deformation, damage, and loose connections as the actuator moves past-center.

Past-center mechanical fasteners have long been used in various applications for locking doors, luggage, containers, window locks, etc. These types of fasteners are typified in U.S. Pat. Nos. 1,451,768 and 1,229,851, wherein past-center cam locks are designed pivot a lever and draw a member toward the lever into a past—or over—center latching position. Such fasteners have not suggested utilization in a wall panel system which would allow for adjustment of the fastener members and have means for inserting and locking one member, while rotatably allowing the camming member to be adjustably positioned prior to pivoting in order to compensate for tolerance variations and thereby achieve a snug fit.

The invention as described below addresses the need in the art for a past-center interlock system which allows for adjustment and achieves a quick and sure connection of frame members requiring only one manually installed interlock per joint when used in cooperation with, for example, a standard hook and slot lock at another location along the frame members.

The invention also satisfies a goal in the panel system by permitting the insertion of an interlock from only one side of a frame joint, so that wall panels supported on an adjacent panel frame need not be removed in order to change the panel configuration of the next panel frame as might be needed during office space remodeling.

SUMMARY OF THE INVENTION

The invention may be summarized as comprising an interlock system for engaging adjacent vertical frame members in a wall panel system comprising a past-center latching device cooperative with keyhole-shaped openings in the webs or faces of the vertical frame members. The past-center latch device provides a pivotal latch bracket with a threaded dowel freely held therein and receiving therethrough the threaded end of a bolt, preferably a carriage bolt. The domed head of the carriage bolt is sized in proportion to a circular aperture of the keyhole-stamped openings formed on the frame members to be insertable therethrough. The carriage bolt head is integrally formed with a square or otherwise polygonal nut portion capable of non-rotational receipt within elongate slots of the keyhole-shaped opening. In that way the latch bracket may rotate said threaded dowel without rotating the head of the carriage bolt whereby to draw two adjacent engaged vertical panel members together. The latch bracket is ultimately pivoted past-center to cam against the web of the respective frame member thereby securing it to the adjacent frame member holding the carriage bolt nut portion thereat. A washer may also be arranged on the carriage bolt and forced evenly against the web of the frame member by camming surfaces of the latch bracket whereby to distribute the force evenly and assure a tight engagement without deforming the surface of the web.

The inventive interlock system requires only a single fastener between adjacent frame members when used in cooperation with, for example, a conventional hook and slot engageable element usually formed at the lower ends of standard tubular vertical frame members of a wall panel system.

The latch bracket has a generally channel shape with side webs that taper away from camming edges thereof at either side of the channel. After the latch bracket is tightened against the washer by threading down along the carriage bolt, the latch bracket is rotated, forcing the camming edges against the washer to complete the interlock between the frame members.

DETAILED DESCRIPTION OF THE INVENTION

Figure 1:
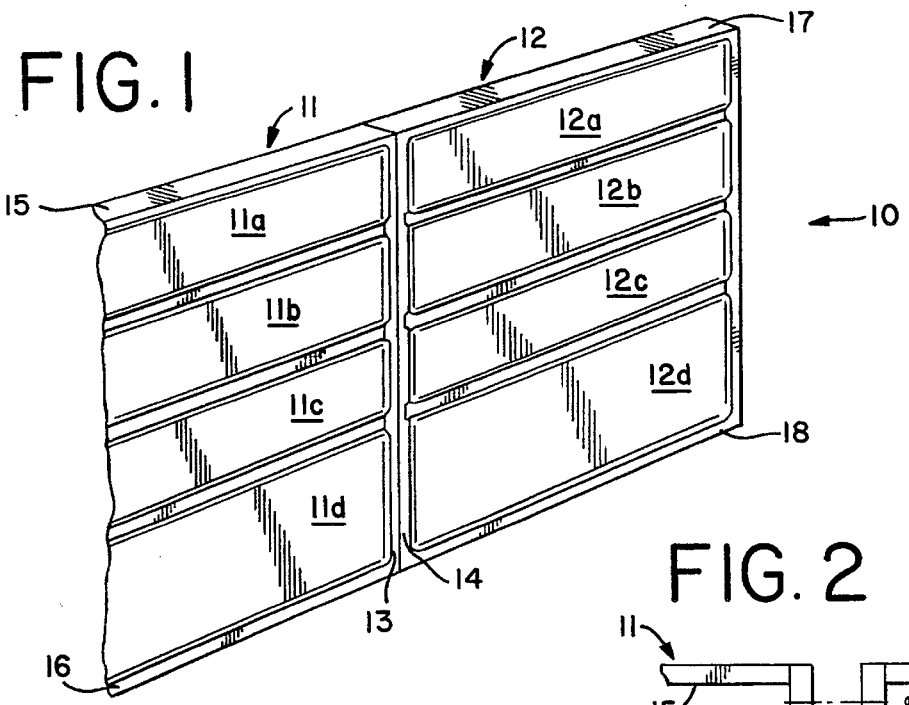
FIG. 1 is a partially broken away perspective view of a portion of a wall panel system showing wall panels supported on adjacent panel frames to provide an aesthetically pleasing wall surface.

Reference will now be made to FIGS. 1–12 wherein the like reference numerals refer to the same elements throughout.

In FIG. 1, a perspective view of a wall panel system 10 is shown with two adjoining panel frames 11, 12, respectively, having mounted thereon decorative panels 11*a–d* and 12*a–d*. These decorative panels are removably attached to the panel frames 11 and 12 in a conventional manner and are illustrated only for purposes of explanation.

Figure 2:
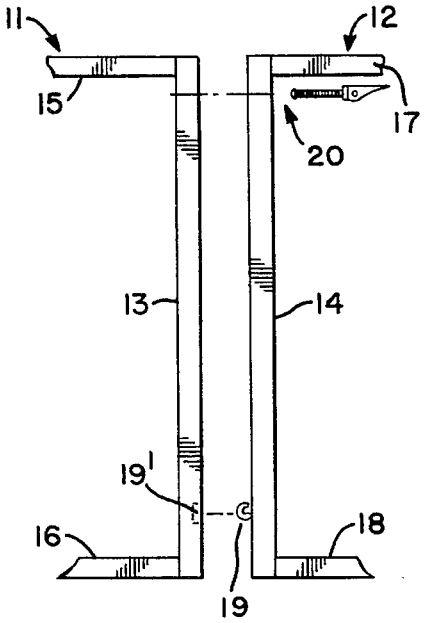
FIG. 2 is an elevational exploded view of two adjacent panel frames being separated for purposes of explanation and showing a conventional hook and slot attachment near the bottom ends of adjacent tubular frame members of each panel frame and the interlock system of the invention generally near the top thereof.
Figure 3:
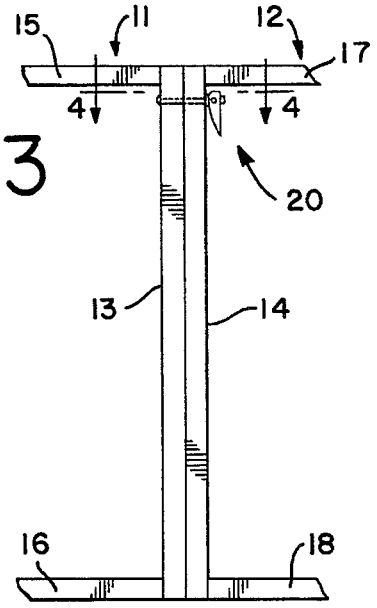
FIG. 3 shows the adjacent panel frames of FIG. 2 in an interlocked engagement wherein the latch bracket of the interlock is in the past-center position thereby locking the vertical frame members, together.

Reference is next made to FIGS. 2 and 3. FIG. 2 is an elevational view of two standard tubular-shaped vertical frame members, 13, 14. Portions of the vertical frame members 13, 14 are apparent in FIG. 1 in the assembled state. The vertical frame member 13 is connected by horizontal frame members 15, 16 forming three sides of the panel frame 11, and frame member 14 is similarly engaged to horizontal member 17, 18 forming three sides of the panel frame 12. At each joint between panel frames of the wall system 10, similar vertical frame members would be provided. The panel frames may be interconnected in straight lines, at angled (usually 90°) corners, or at multiple panel intersections forming T or four-way crossing arrangements. The decorative panels 11*a–d* and 12*a–d* are removably engaged to the vertical support members 13, 14, and conceal non-aesthetic portions of the panel frames 11, 12 in a typical installation.

In FIG. 3, the vertical frame members 13 and 14 are shown interlocked, as illustrated in FIG. 1, and thereby securing the panel frames 11 and 12 together. In the exemplary embodiment, a standard engagement is provided between the vertical frame members 13 and 14 by means of a hook 19 on frame member 14 being insertably engageable in a slot 19' in the vertical frame member 13 in a known way.

Figure 4:
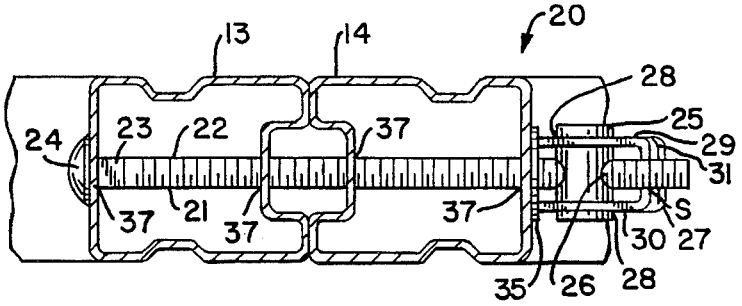
FIG. 4 is a horizontal sectional view taken generally along line 4—4 of FIG. 3 looking in the direction of the arrows and showing the adjacent, generally tubular shaped vertical frame members being secured together by the interlock system invention.

The inventive interlock 20 of the invention is shown disengaged in an exploded view in FIG. 2 and in the interlocked assembled state in FIG. 3 and the cross-sectional view of FIG. 4 therein securing the vertical frame members 13 and 14 tightly together and joining the panel frames 11 and 12 of the wall system 10.

Figure 5:
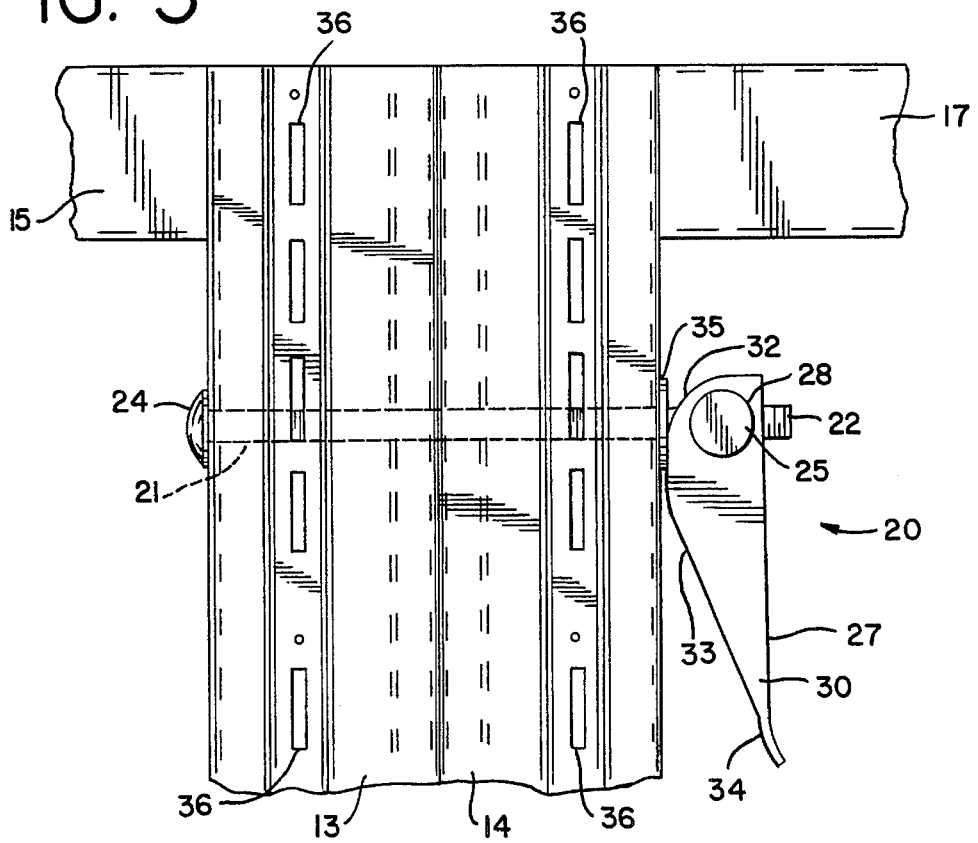
FIG. 5 is a more detailed partial elevational view of the secured vertical frame members as in FIGS. 3 and 4, showing in dashed lines a carriage bolt of the interlock system passing through the vertical frame members and wherein the latch bracket is in the past-center locked position pressing against a washer at one web of one of the tubular frame members for securing the frame members tightly together.

In reference to the sectional view of FIG. 4, the interlock 20 will be seen as comprising a carriage bolt 21 having a long threaded shaft 22 meeting a polygonal, preferably square, nut portion 23 that is integrally formed with a generally semi-spheric or domed crown 2:4. The threaded shaft 22 extends from the square nut 23 to pass through a bored dowel 25 having a threaded bore 26 for thread engagement with the shaft 22. The dowel 25 is held rotationally free about its central axis by a latch bracket 27. In reference also to FIG. 5, the latch bracket 27 includes opposing apertures 28 for loosely holding opposite ends of the rotational dowel 25 therein. The latch bracket 27 thereby is also pivotal with respect to the dowel 25 in a plane orthogonal to the central axis of the dowel 25 and the latch bracket 27 and the dowel 25 also can spin together on and around the threaded shaft 22. In regard to the more detailed views of FIGS. 10–12, the latch bracket 27 is trough-shaped having opposing side webs 29, 30 through which the opposing apertures 28 for rotatably holding the dowel 25 are formed. The bottom of the trough-shaped comprises a cross web 31 joining the side webs 29, 30. The cross web 31 is discontinuous forming a slot S generally in the region of the apertures 28 and dowel 25 in order to allow the latch bracket 27 to pivot and permit the threaded shaft 22 to project outwardly thereof allowing the dowel 25 to be first tightened on the shaft 22 and thereafter the latch bracket 27 to be rotated past-center (FIG. 5).

Edges of the side webs 29, 30, adjacent the vertical frame member 14 to-be-engaged, include curved camming edges 32 that meet a flat and then tapering edge portion thereof referenced at 33 that terminates in a flat finger grip 34 facilitating a manual pivoting cam action. The camming edges 32 are pressed against a washer 35, or equivalent, which is mounted along the shaft 22 to be biased against the frame member 14 and provide a force-distributing, even locking surface against the frame member 14. The washer 35 also prevents slippage during locking and minimizes deformation of the material surface when force is applied during pivoting of the latch bracket 27.

Figure 6:
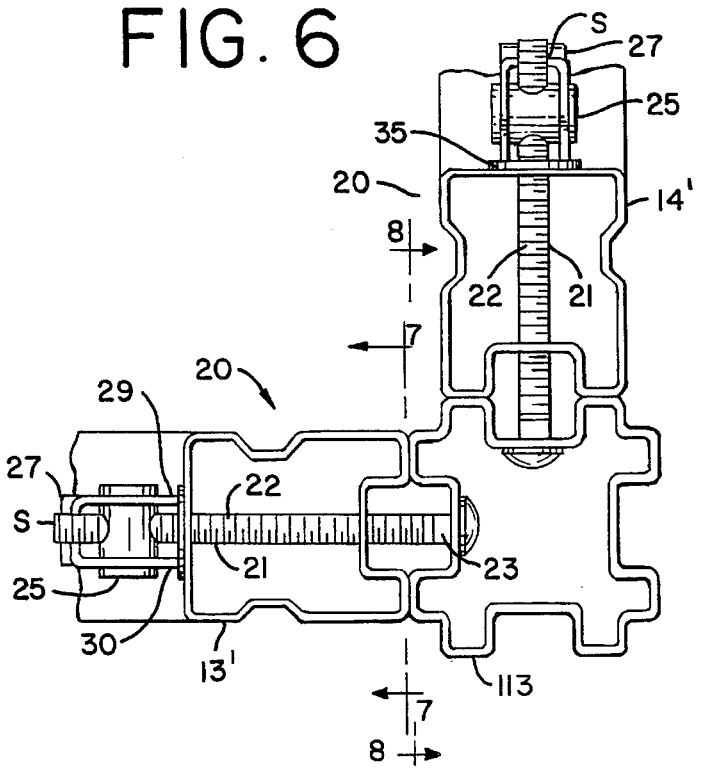
FIG. 6 is a horizontal sectional view like FIG. 4 but illustrating the utilization of the interlock system at a comer of a wall panel system showing two panel frames at right angles to each other and being independently engaged to a tubular connector member at two webs or faces thereof.
Figure 9:
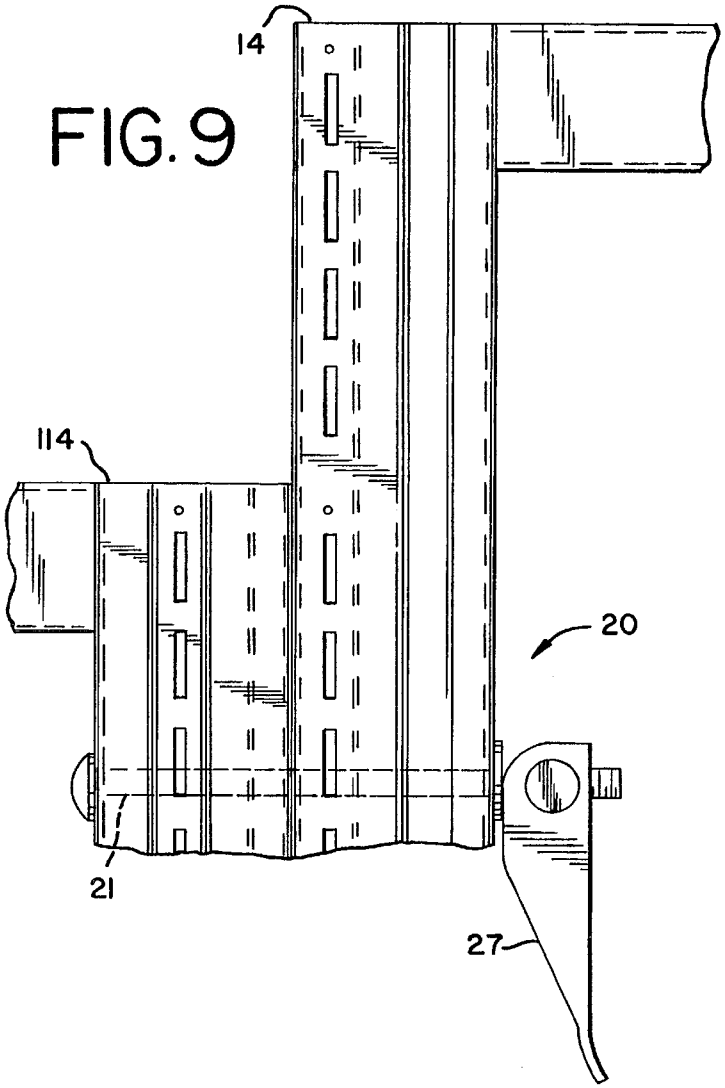
FIG. 9 is a partial elevational view of the connection of two adjacent vertical frame members of different heights for forming panel frame attachments for wall panels wherein the vertical frame members are locked together by the interlock system of the invention.

The vertical frame members 13 and 14 as shown in FIG. 6, include spaced apart slots 36 for receipt of typical engageable hooks (not shown) on the backs of the panels 11*a–d* and 12*a–d* in a conventional configuration. The interlock system 20 advantageously allows for its installation and the interlocking of vertical frame members from only one side a joint, while panels may remain on one of the adjacent panel frames. For example, the panel members 11*a*–11*d* may remain on the panel frame 11, in engagement with the slots 36 of the vertical frame member 13, while the interlock system 20 may be disengaged and possibly re-engaged to a replacement or alternate for the frame member 14. Access is only required at the side where the latch bracket 27 resides to engage and disengage the interlock system 20. This will be explained in greater detail in connection with FIGS. 7 and 8.

In FIG. 6, the interlock system 20 accommodates a comer wall joint having tubular vertical frame members 13' and 14' arranged at fight angles, wherein the carriage bolts 21 are independently engaged to a third vertical frame member comprising a tubular connector 113. The vertical frame members 13' and 14' are drawn tightly against the connector 113 rather than against each other contrary to the in-line installation as shown in FIG. 4. One or two additional connections could be made to the connector 113 to provide a T or four-way panel intersection, as would be understood. The interlock system 20 shown in FIG. 6 provides two carriage bolts 21 and latch brackets 27 at right angles to each other for interlocking each member 13', 14' independently to the connector 113. The interlock 20 is universally applicable to the connections of vertical frame members in various panel joints, such as straight line, angled, T intersection and four-way crossings. Intersections need not be right angles. For example, connector 113 could be three-sided, five sided, etc., instead of a four-sided tube as in the disclosed embodiment. The lengths of the shafts 22 of the carriage bolts 21 may vary to accommodate different sized frame members and joints. For example, at the corner the connector 113, the carriage bolts 21 could be made shorter than in FIG. 4 because they do not pass all the way through the connector 113 as they do "in-line" in FIG. 4 by extending fully through both vertical members 13, 14.

Figure 8:
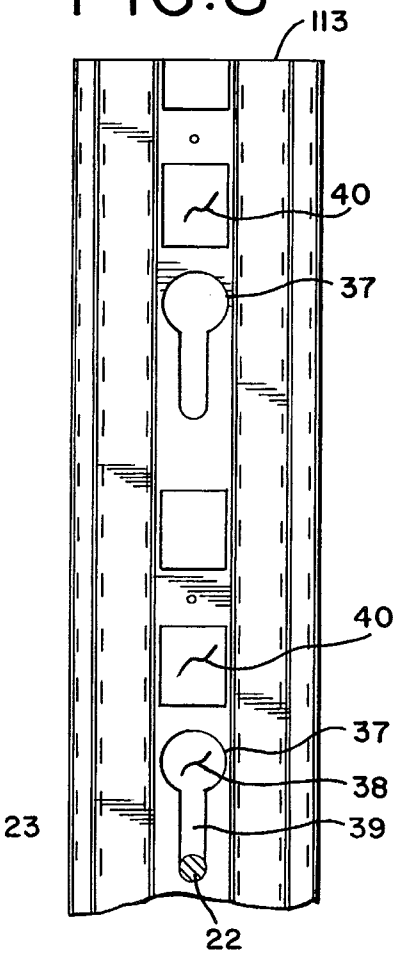
FIG. 8 is a vertical sectional view of FIG. 6 taken along line 8—8 looking in the direction of the arrows and showing the threaded shaft of the carriage bolt to be received within an elongate slot of a keyhole-shaped opening in a web of the connector member interconnecting the two orthogonally arranged vertical frame members, as shown in FIG. 6.
Figure 7:
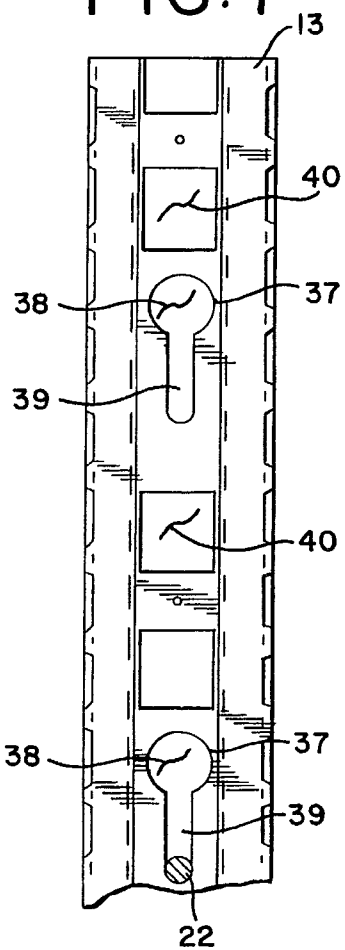
FIG. 7 is a vertical sectional view of FIG. 6 taken generally along line 7—7 looking in the direction of the arrows and showing the passage of the threaded shaft of the carriage bolt to be received within the elongate slot of one of the keyhole-shaped openings formed in a web of a vertical frame member.
Figure 10:
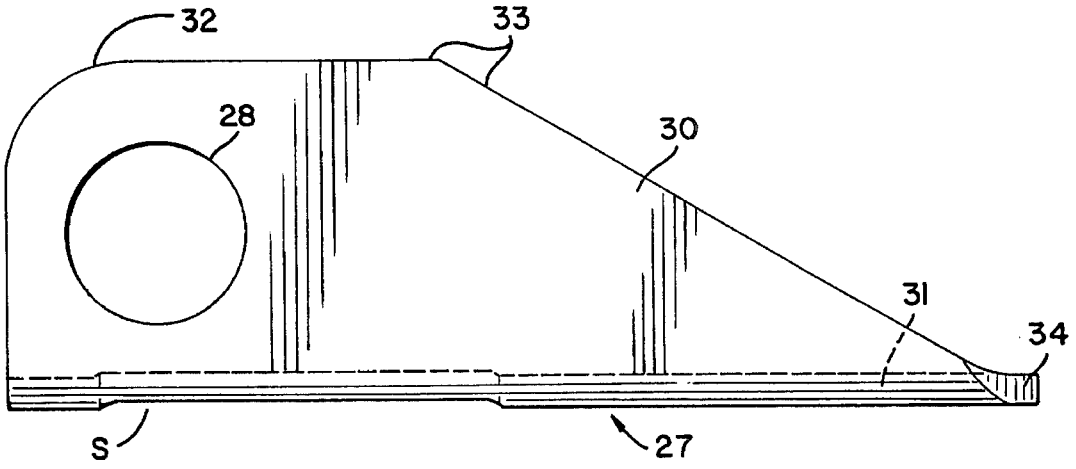
FIG. 10 is a detailed front elevational view of the latch bracket.
Figure 11:
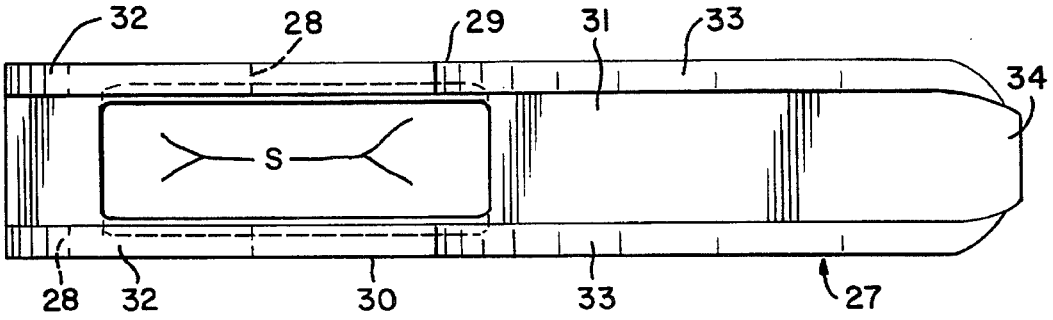
FIG. 11 is a detailed side view of the latch bracket looking from the right of FIG. 5.
Figure 12:
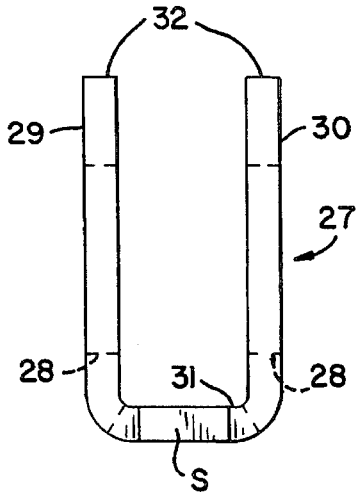
FIG. 12 is a detailed end view of the latch bracket looking from the right of FIG. 11.

The cross-sectional views of FIGS. 7 and 8 are taken along lines 7—7 and 8—8 of FIG. 6 looking in the direction of the arrows. FIG. 7 shows the carriage bolt-engageable portions of the vertical frame member 13 comprising keyhole-shaped openings 37. The keyhole-shaped openings 37 are uniformly made along the vertical frame members 13, 14 and the connector 113, as shown in FIGS. 7 and 8. All vertical members of the wall panel system 10 would have uniform keyhole-shaped openings to allow for the interchangeability and common utilization of standard carriage bolts 21 for engagement throughout. The keyhole-shaped openings 37 include a circular opening 38 joining an elongate slot 39 to form the keyhole shape. The diameter of circular opening 38 is slightly larger than that of the semi-spherical head 24 of a carriage bolt 21 allowing it to pass therethrough. The elongate slot 39 has a width nominally the same as, or slightly larger than, the diameter of the shaft 22 and width of nut portion 23. Thus, the threaded shaft 22 can successfully pass through the slot 39 but, when the bolt portion 23 is dropped into the slot 39, it is prevented from rotation. In the sectional view of FIG. 7, the shaft 22 of the carriage bolt 21 is shown in section. In FIG. 8, the shaft 22 is also shown in section and the polygonal nut portion 23 is shown held in the vertical slot 39 in the connector 113 and prevented from rotation therein.

The keyhole-shaped opening 37 of the interlock system 20 is engageable by the carriage bolt 21 from one side so that access to only one side of a panel frame joint is required. Specifically, the carriage bolt 21 may be horizontally passed through the four aligned keyhole-shaped openings 37 of the frame members 13, 14, as in FIG. 4. It will be understood that the frame members 13, 14, as well as connector 113, would be manufactured to dispose the keyhole-shaped openings 37 in vertically aligned registry. Thereby, when the vertical frame members are placed adjacent each other, the respective keyhole-shaped openings 37 would axially align in horizontal planes. The semi-spheric head 24 of the carriage bolt 21 passes through the circular openings 38 of the four keyhole slots 37 in the straight line connection of FIG. 4. When the semi-spheric 24 emerges through the last circular aperture 38 to extend outwardly from the left of the vertical frame member 13, (FIG. 4), the carriage bolt 21 may then be urged downwardly to seat the polygonal nut portion 23 within the slot 39, which thereby prevents rotation of the carriage bolt 21. To help achieve the placement of the nut portion 23 into the slot 39, the latch bracket 30 may be oriented parallel to the axis of the threaded shaft 22, as shown in FIG. 2. The latch bracket 30 may then be rotated to tighten the threaded dowel 25 along the shaft 22 thereby bringing the camming edges 32 against the washer 35. The installer may then press against the finger grip portion 34 and rotate the latch handle 90° past-center thereby camming the edges 32 against the washer 35 and drawing the semi-spheric head 24 against the vertical frame member 13. The threading adjustability of the dowel 25 along the threaded shaft 22, in cooperation with the curved camming edges 32, creates a very snug interlock between adjoining frame members in a panel system. The axes of the centers of the arcs forming camming edges 32 and the central rotational axis of the dowel 25 are not colinear, which causes the past-center, also known as over-center, cam lock action, as would be understood by those skilled in the mechanical arts. The attachment and snug engagement can be made manually without the use of any hand tools, which is highly desirable since installers are often required to rapidly meet installation deadlines. The interlock system 20 also offers the installer the ability to meet potential misalignment problems caused by imperfectly made panel support members, including slot misalignments, uneven existing floors, variable carpeting or tiles, etc., by virtue of the elongate slot 39. This is because the elongate slot 39 allows for the nut portion 23 of the carriage bolt 21 to be non-rotationally positioned vertically substantially anywhere along the length of the elongate slot 39.

The location of the keyhole-shaped openings 37 would generally be between other standard framing apertures, such as cutouts 40 of the frame members 13 and 113 in FIGS. 7 and 8, which are sometimes made to reduce material weight and cost, and alternately may be formed for the passage of cabling, conduit, wiring and the like.

The interlock system 20 is also capable of use when adjacent vertical frame members have different heights. For example, in FIG. 9 a shorter vertical frame member 114 is shown engaged to vertical frame member 14, such as would result in reference to FIGS. 2–4 by removing vertical frame member 13 and replacing it with frame member 114 to create a different height panel arrangement. The alignment of the keyhole-shaped openings 37 in the vertical frame members 14 and 114 would provide for the identical attachment steps of the carriage bolt 21 and the locking action of the latch bracket 27.

For purposes of describing the preferred embodiment, the carriage bolt 21 shown is a 5/8 16 standard bolt in FIGS. 4 and 5, and a 5/16 18 carriage bolt shown in FIGS. 6–8 for use with the connector 113. The washer 35 is a 5/16 I.D. washer. The spacing of the keyhole-shaped openings 37 in the exemplary embodiments are generally 12 inches on center, wherein the elongate slots 39 are 5/16 inch wide to accommodate the thread diameter of the threaded shaft 22 and width of polygonal nut portion 27 as would be understood.

A wide range of equivalents will be found to fall within the scope of the claims appended hereto and the description of the embodiment of the invention above is for purpose of explaining to the art how to practice the invention.

ACHIEVEMENTS OF THE INVENTION

The invention provides an interlock system for interlocking panel frames meeting at joints in a wall panel system. The inventive interlock system allows for the manual locking together of adjacent vertical frame members without the need for hand tools. The provision of a carriage bolt and keyhole-shaped openings in the vertical frame members allows for a rotational tightening of a latch bracket by means of rotating a freely held dowel that threadably engages a non-rotatably held carriage bolt. Upon threading down to a snug engagement, the latch bracket may be pivoted about 90° to cam against a vertical frame member and thereby forcefully interlock two panel frames in a releasable arrangement, should alteration to the wall panel system be required.

What is claimed is:

1. An interlock system for joining vertical framing members in a wall panel system comprising:

a wall panel system having at least two vertical frame members each having at least one generally keyhole-shaped slot therethrough;

a carriage bolt extending through said at least one generally keyhole-shaped slot of a first of said at least two vertical frame members and having a threaded shaft extending through said at least one generally keyhole-shaped slot of a second of said at least two vertical frame members;

a dowel member having a threaded bore threadably engaged to said threaded shaft of the carriage bolt and being rotatable thereon; and a latch bracket having means for free pivotal attachment to said dowel member and including a cam means for biasing against said second vertical frame member, the latch bracket having means for rotating said dowel member on said carriage bolt, said latch bracket being pivotal around said dowel member to lock the at least two vertical frame members together.

2. The interlock system of claim 1 wherein said carriage bolt has a polygonal nut portion non-rotationally engageable in one said keyhole-shaped opening.

3. The interlock system as in claim 2 wherein said carriage bolt has a head integrally formed with said polygonal nut portion and having a diameter larger than the width of said nut portion, said keyhole-shaped opening including a circular aperture larger than the diameter of said carriage bolt head and an elongate slot means for providing said non-rotational engagement by said polygonal nut portion.

4. The interlock system as in claim 1 wherein said latch bracket comprises a pair of side webs integrally joined by a cross web, the side webs having a pair of opposing apertures forming said means for free pivotal attachment to said dowel member, said transverse bore of the dowel member residing between said pair of opposing apertures.

5. The interlock system as in claim 4 wherein the cam means comprises two edges of the side webs of the latch bracket.

6. The interlock system as in claim 5 further comprising a washer mounted on the threaded shaft of the carriage bolt to be adjacent and receive camming force from said two edges during pivoting of said latch bracket around said dowel member.

7. The interlock system as claimed in claim 1 wherein said first and second of said at least two vertical frame members are engaged by separate engagement means at a location therealong spaced from said carriage bolt and latch bracket.

8. A system of interlockable panel frames, each panel frame having means for engageably attaching wall panels thereto, comprising: vertical support members and horizontal support members, a plurality of the vertical support members being located at joints between panel frames and the vertical support members at said joints each having a tubular configuration, slot means formed through said vertical support members at spaced apart intervals therealong whereby corresponding slot means align generally in horizontal registry; at one of said joints between panel frames, a carriage bolt extending through at least two registering slot means of the vertical support members, the carriage bolt having a head, an integral polygonal nut portion and a threaded shaft extending from the nut portion to project through the slot means in a first of said vertical support members, and said polygonal nut non-rotatably engaged in the slot means of a second of said vertical support members, the threaded shaft extends outwardly of the slot means of the first of said vertical members; a rotatable latch bracket pivotally retaining a dowel member having means for thread-engaging the threaded shaft of the carriage bolt, the latch bracket being rotatable to rotate the dowel member on said threaded shaft of the carriage bolt to cause the latch bracket to travel to or away from said first of said vertical support members; and, said latch bracket being pivotable around said dowel member, and the latch bracket including camming means for camming against said first of said vertical support members whereby to draw said frame members together for interlocking adjacent panel frames.

9. The system as in claim 8 wherein the latch bracket has opposing apertures, the dowel member being freely pivotally engaged to said latch bracket at said opposing apertures.

10. The system as in claim 8 wherein the slot means are keyhole-shaped and comprise a circular opening capable of receiving the head of the carriage bolt therethrough and an elongate slot portion being slightly wider than said polygonal nut, whereby to be capable of receiving said nut portion therein and prevent rotation thereof.

11. The system as in claim 8 wherein said latch bracket comprises a trough-like configuration having two opposing side webs joined by a cross web for less than the full length thereof to form a slot in the cross web and said side webs having camming surfaces opposite the cross-web comprising said camming means, the camming surfaces including circular portions for biasing against said first of said vertical support members and pivoting the latch bracket past-center to lock against said first of said vertical support members, said side webs tapering from the camming surfaces to a manual finger grip facilitating manually pivoting said latch bracket past-center to the locked position.

12. The system as in claim 8 wherein said second of said vertical support members comprises a connector member having slot means therethrough for separately engaging at least two carriage bolts, one carriage bolt extending from said first of said vertical frame members and the other carriage bolt extending from a third of said vertical frame members, said first and third of said vertical frame members being members of two separate panel frames residing at an angular relationship to each other and being independently interlocked to the connector member.

13. An interlock for locking a first vertical frame member to a second vertical frame member in a wall panel system, said first vertical frame member and the second vertical frame member each including at least one keyhole-shaped opening vertically aligned with the at least one keyhole-shaped opening of the other, a bolt means passing through both said keyhole-shaped openings, said bolt means having a head and said keyhole-shaped openings having a first aperture capable of receiving said head therethrough, said bolt means having a polygonal nut having a width less than the width of said head and wherein said keyhole-shaped openings include a second aperture formed continuously with the first aperture for non-rotatably holding said polygonal nut of the bolt means, the polygonal nut being non-rotatably held in the keyhole-shaped opening of said second vertical frame member, said bolt means having a threaded shaft extending from said polygonal nut to extend through said keyhole-shaped opening of the first vertical frame member; a rotatable means having a threaded bore therethrough, the threaded bore being threadably engaged to said threaded shaft of the bolt means, said rotatable means being freely pivotally retained by a pivotal lever bracket; the lever bracket capable of rotating the rotatable means along said threaded shaft whereby to move the lever bracket toward and lock against said first vertical frame member, said lever bracket being pivotal around said rotatable means, said lever bracket including camming surfaces capable of camming against said first vertical frame member by the pivoting of said lever bracket around said rotatable means whereby to cam against said first vertical frame member and draw said bolt means and the second vertical frame member toward the first vertical frame member to interlock the first and second vertical frame members together.

14. The interlock as in claim 13 wherein said threaded shaft of the bolt means has a washer thereon disposed outwardly of said first vertical frame member for receiving the camming force of said lever bracket upon pivoting and camming against the first vertical frame member.

15. The interlock as in claim 13 wherein said lever bracket comprises a pair of side webs integrally formed for less than the full lengths thereof by a cross web, said camming surfaces comprising edges of said side webs opposite said cross web, said camming edges including circular portions for cam action locking against said first vertical frame member and said side webs terminating in tapered edges tapering generally from said camming surfaces to terminate in a finger grip for grasping by the fingers to pivot said lever bracket.

16. The interlock as in claim 13 wherein said rotatable means comprises a solid dowel having said threaded bore extending transversely therethrough for thread engagement with said threaded shaft.

17. The interlock as in claim 13 wherein said first vertical frame member and said second vertical frame member are each tubular in configuration and wherein each has at least two aligned keyhole-shaped openings whereby the bolt means extends through at least four keyhole-shaped openings.

18. The interlock as in claim 13 wherein the latch bracket pivots over center to interlock.

19. The interlock as in claim 13 wherein the second vertical frame member is substantially identical to the first vertical frame member.

20. The interlock as in claim 13 wherein the second vertical frame member is a connector connected by a second independent and substantially identical interlock to a third vertical frame member being substantially identical to said first vertical frame member, whereby the connector is independently interlocked to both said first and third vertical frame members.

21. The interlock as in claim 13 wherein the bolt means comprises a carriage bolt.

* * * * *